US010184265B2

(12) United States Patent
Pashandi

(10) Patent No.: US 10,184,265 B2
(45) Date of Patent: Jan. 22, 2019

(54) AUTOMATICALLY DEPLOYING SHIELDING APPARATUS

(71) Applicant: Jalal Pashandi, Los Angeles, CA (US)

(72) Inventor: Jalal Pashandi, Los Angeles, CA (US)

( * ) Notice: Subject to any disclaimer, the term of this patent is extended or adjusted under 35 U.S.C. 154(b) by 0 days.

(21) Appl. No.: 15/838,117

(22) Filed: Dec. 11, 2017

(65) Prior Publication Data

US 2018/0100327 A1 Apr. 12, 2018

Related U.S. Application Data

(63) Continuation-in-part of application No. 15/233,550, filed on Aug. 10, 2016, now Pat. No. 9,874,038.

(60) Provisional application No. 62/504,435, filed on May 10, 2017.

(51) Int. Cl.

| | |
|---|---|
| ***E04H 15/48*** | (2006.01) |
| ***E04H 15/58*** | (2006.01) |
| ***A45B 11/00*** | (2006.01) |
| ***A45B 25/16*** | (2006.01) |
| ***E04H 15/44*** | (2006.01) |
| *A45B 23/00* | (2006.01) |

(52) U.S. Cl.

CPC ..... *E04H 15/48* (2013.01); *A45B 11/00* (2013.01); *A45B 25/16* (2013.01); *E04H 15/44* (2013.01); *E04H 15/58* (2013.01); *A45B 2023/0012* (2013.01)

(58) Field of Classification Search

CPC ..... E04H 15/48; E04H 15/58; E04H 15/34; E04H 15/003; A45B 23/00; A45B 2023/0093; A45B 202/0012

USPC ..... 135/120.3, 19.5, 20.1

See application file for complete search history.

(56) References Cited

U.S. PATENT DOCUMENTS

| | | | | |
|---|---|---|---|---|
| 1,493,915 | A * | 5/1924 | Baker | E04H 15/003 135/146 |
| 2,888,021 | A * | 5/1959 | Adams | A45B 23/00 135/114 |
| 7,278,245 | B2 * | 10/2007 | Rouse | A47B 3/002 108/118 |
| 9,066,512 | B2 * | 6/2015 | Nolz | F41A 23/14 |
| 9,714,068 | B1 * | 7/2017 | Greer | B63B 17/02 |
| 2007/0034342 | A1 * | 2/2007 | Fill | A45B 11/00 160/351 |
| 2017/0202321 | A1 * | 7/2017 | Maurello | A45B 23/00 |

* cited by examiner

*Primary Examiner* — Noah Chandler Hawk
(74) *Attorney, Agent, or Firm* — Edwin Tarver

(57) ABSTRACT

An automatically deploying shielding apparatus, or sun shade, includes a handle and a shade portion connected by a hub. The handle extends into the hub, with the shade portion having a flexible shade joined to a first support member and a second support member. The first support member and the second support member extend into the hub, and an elastic member extends from the first support member to the second support member. The elastic member is arranged to extend through the hub and the first support member and the second support member are coupled to the hub portion with the elastic member holding the first support member and the second support member under tension at a position substantially perpendicular to the handle. A rescue cord and notch may be provided as an alternative to the elastic member, or in the event of malfunction of the elastic member, for manual operation.

20 Claims, 6 Drawing Sheets

AUTOMATICALLY DEPLOYING SHIELDING APPARATUS

RELATED APPLICATIONS

This application claims the benefit of the priority filing date of U.S. provisional patent application Ser. No. 62/504,435, "Pronto Sunshade," which was filed on May 10, 2017 and is incorporated herein by reference in its entirety.

BACKGROUND

Sun shading apparatus and sun shading devices are known in the art. These devices are typically large apparatus for either casting a shadow over a user's entire body, or comprise an enclosure for surrounding a user, thus preventing the sun's rays from reaching them. Pop-up sun shading apparatus are also known, and are usually designed either to shield the entire body of a user, or may comprise umbrella-like structures that a user must carry. In addition to being cumbersome to carry, these apparatus often have short operational life spans. Although umbrella-like structures are appropriate for shielding only a portion of a user's body, they are usually made for carrying, and are inconvenient for placing over a user in a prone, sun bathing position. These apparatus also involve complex mechanics for opening and closing, which makes them expensive to manufacture and malfunction easily. Because they are typically not aerodynamic, they also present a safety hazard in heavy winds, which may cause them to blow them away and cause breakage or injury.

Sunbathers frequently desire even sun exposure when tanning during summer months. Although sunbathers desire even tanning over most portions of the body, they frequently wish to avoid full sun exposure on the head and face, and upper chest areas. This is because the head, face and upper chest require less tanning as they are naturally exposed to sunlight on a daily basis, and due to the deleterious effects of sunlight (i.e., UV rays) on a sunbather's skin. Conventional sun shading apparatus, being either too large, are thus inconvenient for selective body exposure, or are cost prohibitive due to complicated mechanics and manufacturing requirements that fail to address the needs of sunbathers desiring an inexpensive, easy to use shading apparatus for the head and face while sunbathing.

Hence, what is needed is a sun shading device that makes it easy for a user to block direct sunlight, and in particular UV radiation from sunlight, selectively, on sensitive areas of the user's body (e.g., face and neck). There is also a need for a sun shading device designed to quickly and automatically pop up, opening to its full and final configuration with a very simple strap release motion and minimal effort on the part of a sunbather. There is also a need for a sun shading device that is aero-dynamic and which cannot be easily caught by the wind. There is also a need for a sun shading device that collapses and folds for easy transport and storage, thereby encouraging sunbathers to use it more often. There is also a need for a sun shading device that is aerodynamic and resistant to wind interference. There is also a need for a sun shading device that is inexpensive to manufacture, and which can be easily adapted for branding or other promotional purposes.

SUMMARY

An automatically deploying shielding apparatus, or sun shade, includes a handle portion and a shade portion connected by a hub portion. The handle portion extends into the hub portion, with the shade portion having a flexible shade joined to a first support member and a second support member. The first support member and the second support member extend into the hub portion, and an elastic member extends from the first support member to the second support member. The elastic member is arranged to extend through the hub portion. The first support member and the second support member are hingedly coupled to the hub portion and the elastic member is arranged to hold the first support member and the second support member under tension at a position substantially perpendicular to the handle portion.

In various alternative embodiments, the handle portion may include an elongated handle inserted into the hub portion. The handle portion may also include a hand grip. The shade is preferably substantially triangular, and may include piping, such that the first support member and the second support member extend through the piping anchoring the shade thereto. The first support member preferably includes a first anchorage, and the second support member preferably includes a second anchorage, with the elastic band coupled between the first anchorage and the second anchorage.

In one embodiment, the first support member has a first spherical end and the second support member has a second spherical end. The hub portion has a body portion and a cap portion, and in the body portion, a first seat and a second seat are provided. Thus, the first spherical end of the first support member is located in the first seat and the second spherical end of the second support member is located in the second seat, enabling the first support member and the second support member to swing back and forth relative to the body portion. The elastic band preferably extends around a grooved catch disposed in the hub portion, and the hub portion preferably has a first slot and a second slot configured for the first support member and the second support member to travel along them, respectively.

In an alternative embodiment, the apparatus may be characterized as an automatically deploying shielding apparatus having a handle affixed to a hub, with the hub including a body portion and a cap portion affixed to the body portion. A flexible shade is affixed to a first support member and a second support member, with the first support member and the second support member extending into the hub. A first elastic member extends from the first support member to the second support member, with the first elastic member further arranged to extend through the hub. The first support member and the second support member are preferably hingedly secured in the hub between the body portion and the cap portion and the first elastic member is arranged to hold the first support member and the second support member under tension at a position substantially perpendicular to the handle.

In various preferred embodiments, the first support member may include a first spherical end and the second support member may include a second spherical end. The body portion preferably includes a first seat and a second seat. Thus, the first spherical end is located in the first seat while the second spherical end is located in the second seat. The body portion preferably includes a first slot and a second slot configured for the first support member and the second support member to travel along them, respectively, and the apparatus may include a third support member, with the third support member extending into the hub. Preferably, a second elastic member is arranged to hold the third support member under tension at a position substantially perpendicular to the handle.

The apparatus may also be characterized as an automatically deploying shielding apparatus having a hub with a handle affixed thereto in a static relationship, the handle extending distally from the hub, a shade affixed to a first support member, a second support member, and a third support member, the shade hingedly coupled to the hub by the first support member, the second support member, and the third support member. The hub also including a first slot, a second slot, and a third slot, with the first slot, the second slot, and the third slot arranged for the first support member, the second support member, and the third support member to travel therethrough, respectively. An elastic member extends between the first support member and the second support member, with the first elastic member arranged to hold the first support member and the second support member under tension at a position substantially perpendicular to the handle.

DETAILED DESCRIPTION

The following description is presented to enable any person skilled in the art to make and use the invention, and is provided n the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
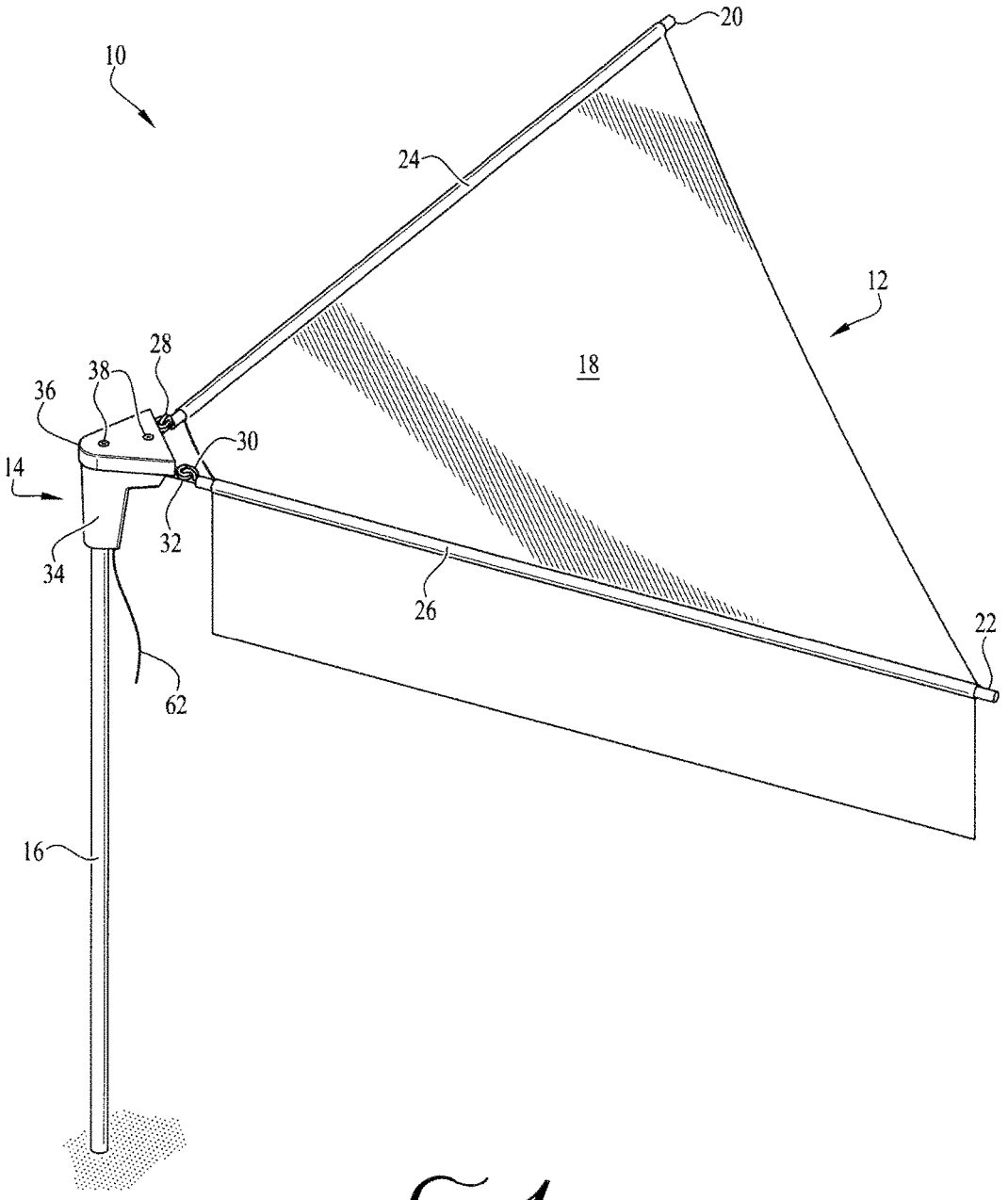
FIG. 1 illustrates a perspective view of the automatically deploying shielding apparatus.

Referring to FIG. 1, the automatically deploying sun shading apparatus 10, includes a shade portion 12, a hub 14 and a handle 16. The shade portion 12 includes a substantially triangular delta-shaped shade 18, preferably supported by a first support member 20 and a second support member 22. The shade 18 may be opaque or translucent, and may be made of virtually any organic cloth-like material, or may be made of inorganic materials, such as plastics, as long as they are sufficiently flexible to have cloth-like properties. Preferably the shade 18 is substantially delta-shaped, broadening as it extends away from the hub 14. By present in a delta-shaped profile the apparatus 10 is resistant to wind interference, and dislodging in windy conditions. The first support member 20 and the second support member 22 are preferably thin, elongated dowel-like structures sufficiently resilient to support the shade 18, depending on its material type, in an expanded configuration.

To ensure proper anchorage, in the illustrated embodiment, the shade may comprise a first piping 24 through which the first support member 20 extends, and a second piping 26 through which the second support member 22 extends. The first support member 20 includes a first anchorage 28 and the second support member 22 includes a second anchorage 30, with the first anchorage 28 and the second anchorage 30 preferably proximal the hub 14 for attaching to an elastic band 32 extending into the hub 14. In the preferred embodiment, a single elastic band 32 is provided, the elastic band 32 extending from the first anchorage 28 to the second anchorage 30 through the hub 14.

The hub 14 preferably disposes the first support member 20 and the second support member 22, and by extension, the shade 18 at a substantially ninety-degree angle from the handle 16. Since the handle 16 is designed to be held or installed substantially vertically when in use, the first support member 20 and the second support member 22 hold the shade 18 in a substantially planar horizontal position above a user. In certain embodiments, the handle 16 may be made of a simple dowel-like structure, such as a rod made of wood or other inexpensive material. Alternatively, the handle 16 may be made of other materials such as metal or plastics, and may include additional features not shown, such as a hand grip to assist a user when holding the apparatus 10, or a sharpened end for insertion into the ground. In various embodiments, the handle 16 may function as a stand with attachment apparatus known in the art, and thus can be affixed to a moving object such as a bicycle, motorcylcle, wheelchair, etc. The hub 14, in the illustrated embodiment, preferably comprises a body portion 34 and a cap portion 36, which are separable for installing the elastic band 32 in the hub 14 when manufacturing the apparatus 10. In the illustrated embodiment, the cap portion 36 is affixed to the body portion 34 with removable screws 38. Also shown is a rescue cord 62 for pulling the support members 20, 22 into position manually.

Figure 2:
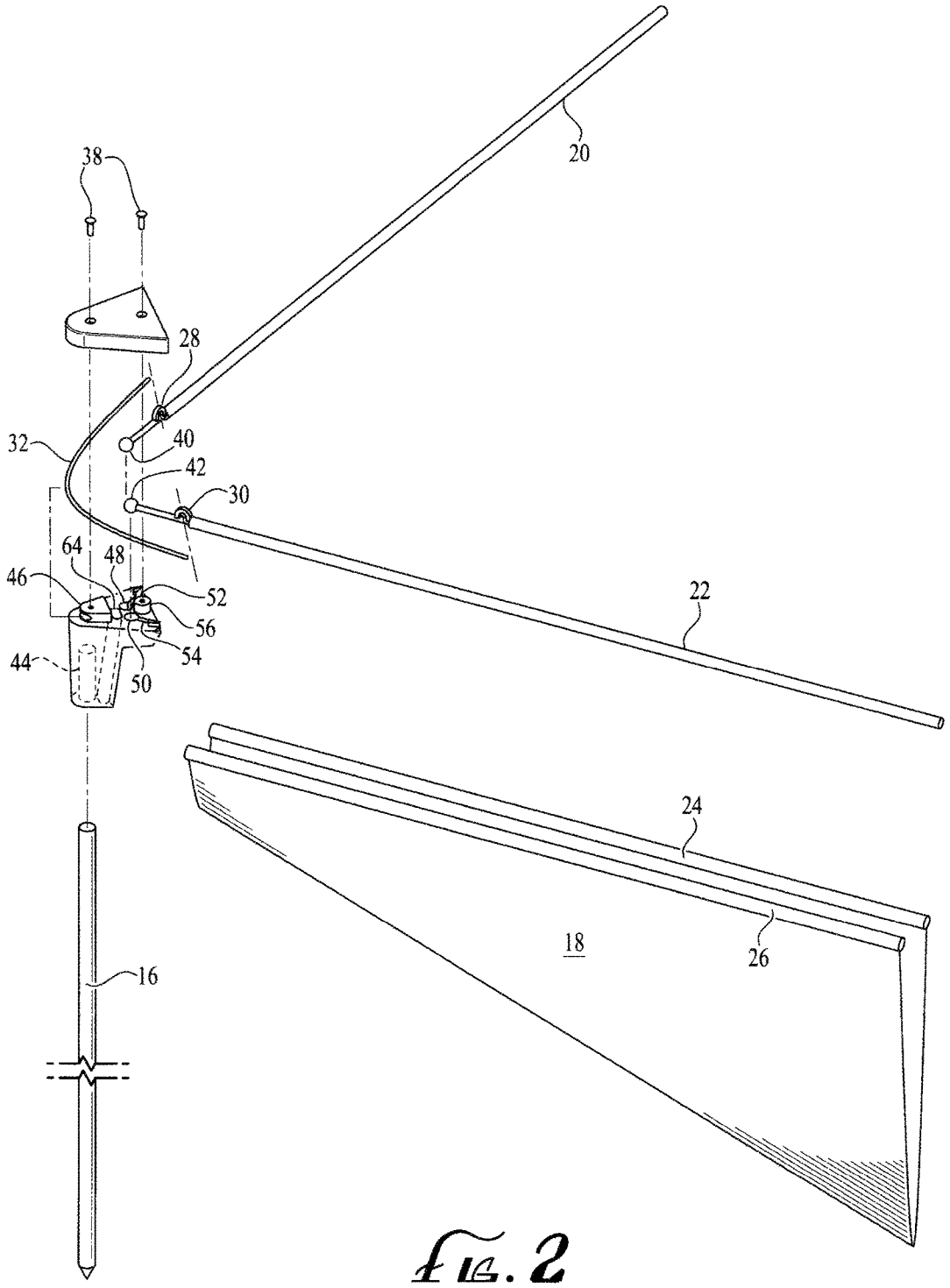
FIG. 2 illustrates an exploded view of the apparatus.

Referring to FIG. 2, the apparatus 10 and its components are shown prior to assembly. In this view, the entire first support member 20 and the second support member 22 are shown, including the first anchorage 28 and the second anchorage 30 as well as a first spherical end 40 and second spherical end 42. The first spherical end 40 and the second spherical end 42 are used to anchor the first support member 20 and the second support member 22 inside the hub 14 in a rotational arrangement allowing the first support member 20 and the second support member 22 to swing up and down from adjacent the handle 16, to a position extending outward substantially ninety degrees from the handle 16.

Also shown in FIG. 2 are certain interior details of the hub 14. The hub 14 preferably includes a bore 44 into which the handle 16 is inserted. The bore 44 is preferably sufficiently deep such that the hub 14 cannot move relative to the handle 16 when the first support member 20 and the second support member 22 are urged down adjacent the handle 16. The hub 14 also includes an grooved catch 46 around which the elastic band extends, and to which the grooved catch 46 imparts tension. Also provided in the hub 14 are a first seat 48 and a second seat 50.

The first spherical end 40 and the second spherical end 42 of the first support member 20 and the second support member 22, respectively, are inserted into the first seat 48 and the second seat 50. A first slot 52 extends from the first seat 48 and a second slot 54 extends from the second seat 50. With the first spherical end 40 seated in the first seat 48, the first support member 20 can swing up and down, passing through the first slot 52. Likewise, with the second spherical end 40 seated in the second seat 50, the second support member 22 can swing up and down, passing through the second slot 54. In a preferred embodiment, a cap post 56 is located between the first slot 52 and the second slot 54. The cap post 56 is provided to support the cap portion 36 and provide anchorage for one of the screws 38.

Figure 3:
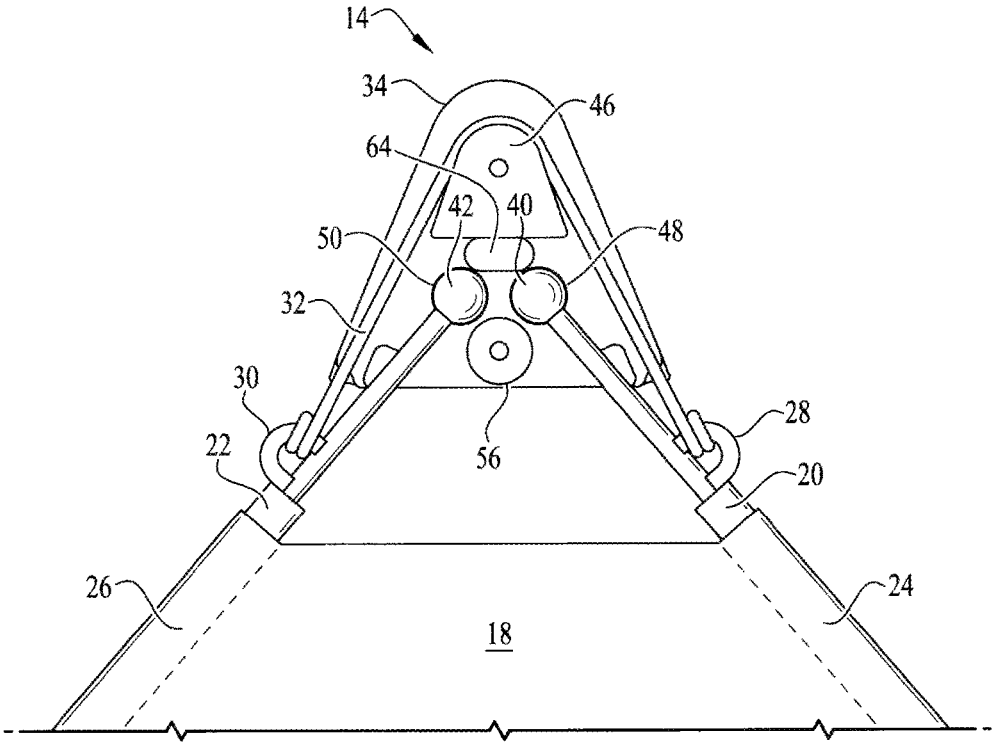
FIG. 3 illustrates a top plan view of the apparatus with the cap removed.

FIG. 3 shows the body portion 34 of the hub 14 with the cap portion 36 removed, illustrating how the apparatus 10 might appear when partially assembled before replacement of the cap portion 36. In this view, the first spherical end 40 is seated in the first seat 48 and the second spherical end 42 is seated in the second seat 50. When the cap is replaced, it confines the first spherical end 40 in the first seat 48, and also confines the second spherical end 42 in the second seat 50. The first support member 20 and the second support member 22 are located in the first slot 52 and the second slot 54, respectively, thus the first support member 20 and the second support member 22 are confined to each rotating in a single plane governed by the positions of the first slot 52 and the second slot 54. Also in this view, the elastic band 32 is shown anchored at either end to the first anchorage 28 of the first support member 20 and the second anchorage 30 of the second support member 22. The elastic band 32 extends around the grooved catch, thus placing the elastic band 32 under tension. Preferably there is a portal 64 through which a rescue cord 62 (FIG. 1) extends for manually raising the first support member 20 and second support member 22.

Figure 4:
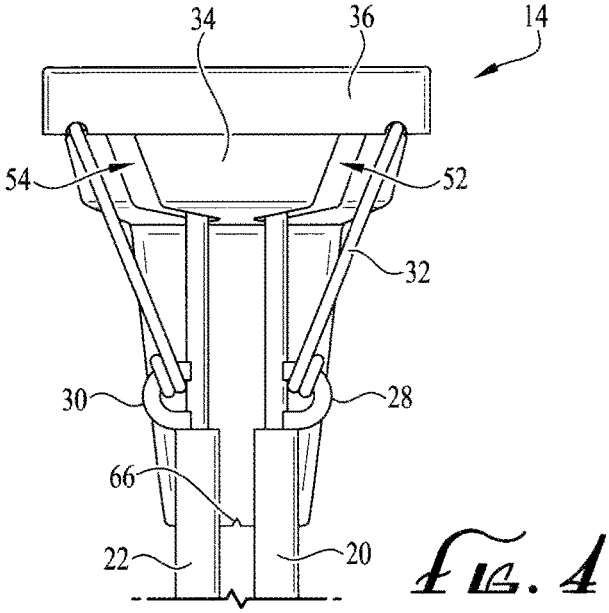
FIG. 4 illustrates a front elevation view of the apparatus with the shade retracted.

FIG. 4 shows the body portion 34 of the hub 14 with the cap portion 36 installed, illustrating the apparatus 10 assembled, and with the first support member 20 and the second support member 22 folded down for stowing and storage. When the cap portion 36 is installed over the body portion 34, the first spherical end 40 and the second spherical end 42 are confined in the first seat 48 and second seat 50, respectively, and are held in place as the first support member 20 and the second support member 22 slide through the first slot 52 and the second slot 54, respectively. In the process, the first anchorage 28 and the second anchorage 30 pull the elastic band 32 away from the hub 14, causing it to stretch, and thereby causing the first support member 20 and the second support member 22 to come under tension when brought adjacent the handle 16. Thus, by simply releasing the first support member 20 and the second support member 22, the elastic band 32 will retract, raising the first support member 20 and the second support member 22, and thereby unfurling the shade 18 as they move up and away from one another. A notch 66 is provided for anchoring the rescue cord 62 (FIG. 1) that extends through the portal 64 (FIG. 3). Preferably the rescue cord 62 will include hooks or features adapted to connect to the first anchorage 28 and the second anchorage 30. Thus, by removing the cap, a user can attach the rescue cord and raise the shade 18 manually. Due to harsh environments which may promote failure of the elastic band 32 and its properties, the apparatus 10 is equipped with the rescue cord 62. The rescue cord 62 also prolongs the lifespan of the apparatus in case of repeated and long term use.

Figure 5:
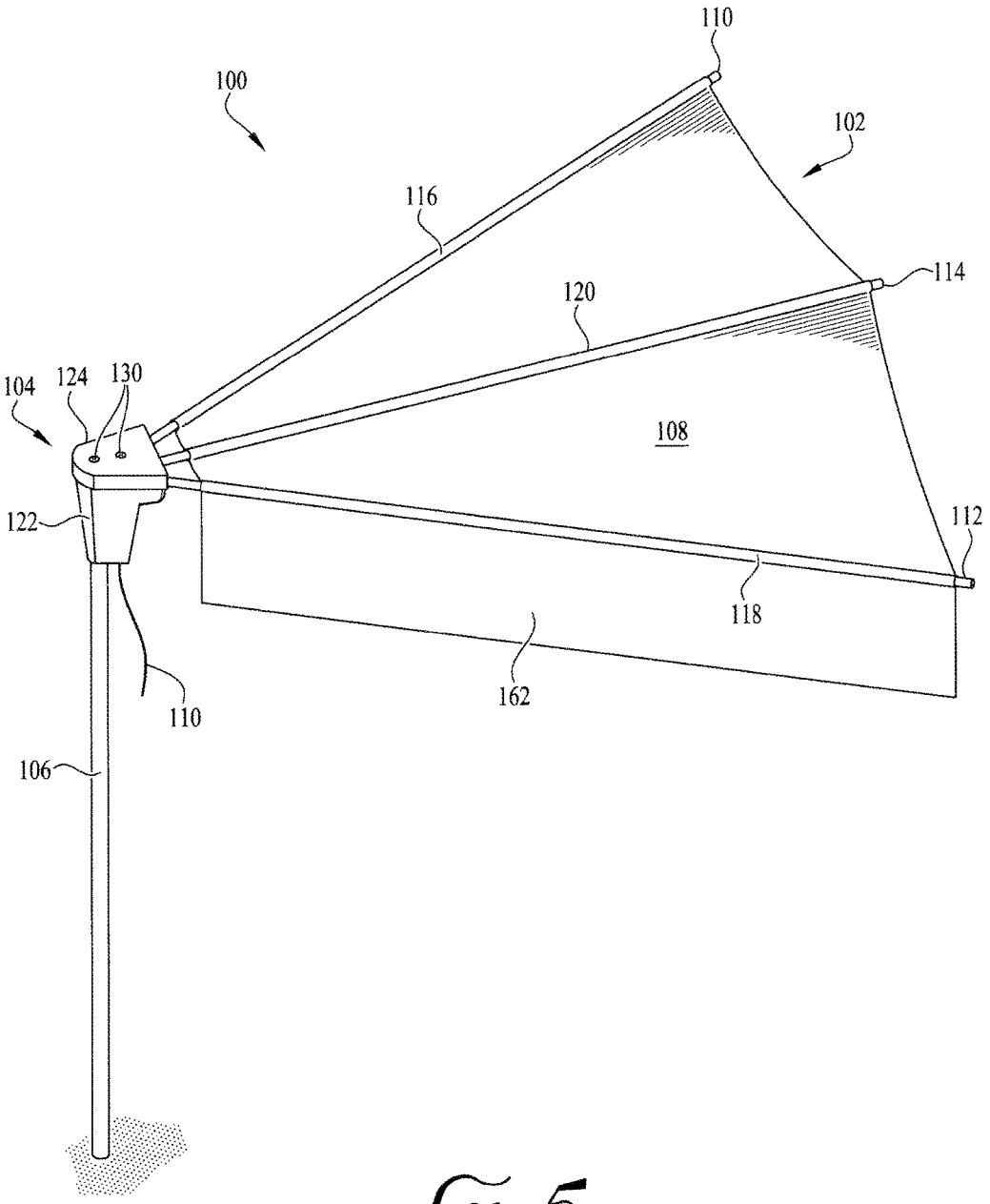
FIG. 5 illustrates a perspective view of an alternative embodiment automatically deploying shielding apparatus.
Figure 6:
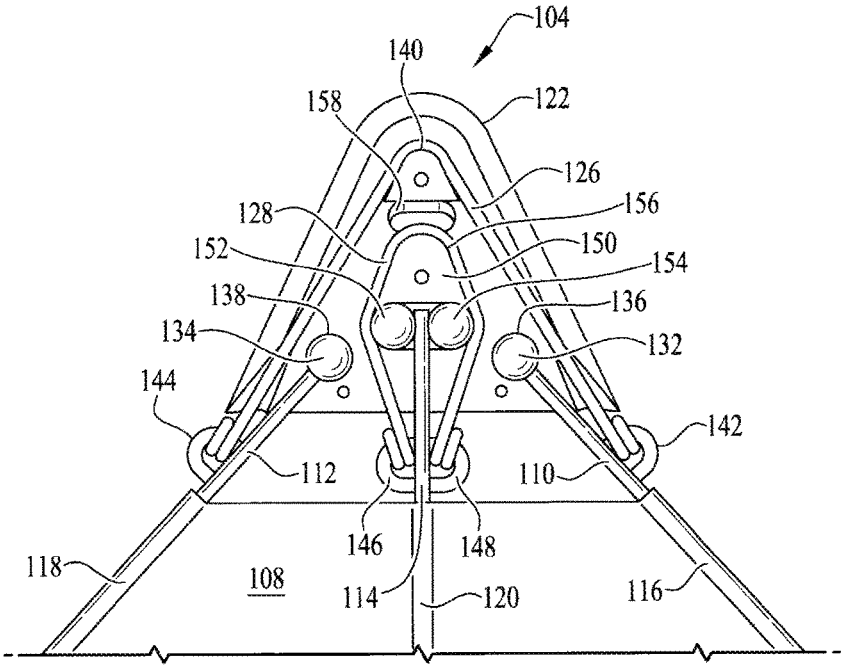
FIG. 6 illustrates a top plan view of an alternative embodiment automatically deploying shielding apparatus having three dowels.

Referring to FIGS. 5 and 6, an alternative three-arm embodiment apparatus 100 is shown. In this embodiment, the apparatus 100 includes a shade 102, a hub 104, a handle 106, and a shade 108 extending between a first support member 110 and a second support member 112, but also includes a third support member 114 preferably located centrally between the first support member 110 and the second support member 112. The first support member 110 preferably includes a first piping 116 to anchor the shade 108 to the first support member 110. The second support member 112 preferably includes a second piping 118 to anchor the shade 108 to the second support member 112, and the third support member 114 preferably includes a third piping 120 anchoring the shade 108 to the third support member 114.

Similar to the first embodiment, the shade 108 of the apparatus 100 may be opaque or translucent, and may be made of virtually any organic cloth-like material, or may be made of inorganic materials, such as plastics, as long as they are sufficiently flexible to have cloth-like properties. Likewise, the first support member 110, the second support member 112, and the third support member 114 are preferably thin, elongated dowel-like structures sufficiently resilient to support the shade 108, depending on its material type, in an expanded configuration.

Also similar to the first embodiment, the hub 104 of the apparatus 100 preferably disposes the first support member 110, the second support member 112 and the third support member 114, and by extension, the shade 108 at a substantially ninety-degree angle from the handle 106. A rescue cord 160 extends downward from the hub 104 for manually lifting the first member 110, second support member 112, and third support members 114. Since the handle 106 is generally vertical when the apparatus 100 is in use, the first support member 110, second support member 112, and third support member 114 preferably hold the shade 108 in a substantially planar horizontal position above a user. Alternatively, the apparatus 100 may be constructed such that the third support member 114 rises slightly higher than the first support member 110 and the second support member 112, thus imparting a gable-like slant to the shade 108. Such a configuration is particularly useful when the apparatus 100 is used to protect a user from rain, allowing water to drain off the shade 108.

In various embodiments, as in the first embodiment, the handle 106 of the apparatus 100 may comprise a simple dowel-like structure, such as a rod made of wood or other inexpensive material. Alternatively, the handle 106 may be made of other materials such as metal or plastics, and may include the contemplated additional features, such as a hand grip for holding the apparatus 10 or a sharpened end for anchorage in a surface. Also, similar to the first embodiment, the hub 104 of the apparatus 100 comprises a body portion 122 and a cap portion 124, which can be separated for installing a first elastic band 126 and a second elastic band 128 (FIG. 6) in the hub 104 when manufacturing the apparatus 100. Likewise, the cap portion 124 is affixed to the body portion 122 with removable screws 130.

FIG. 6 shows the body portion 122 of the hub 104 with the cap portion 124 removed, such as when the apparatus 100 is being assembled or disassembled. In this view, the first spherical end 132 of the first support member 110 and the second spherical end 134 of the second support member 112 are shown seated in the first seat 136 and the second seat 138, respectively, with the first elastic band 126 traveling around the first grooved catch 140 to the first anchorage 142 and the second anchorage 144 in a manner similar to the first embodiment apparatus (i.e., 10). In the alternative embodiment apparatus 100 however, the third support member 114 includes a third anchorage 146 and a fourth anchorage 148, to which the second elastic band 126 is preferably affixed. Like the first embodiment, in three arm embodiment, when the cap portion 124 is replaced, it locks the third support member 114 in position.

The second elastic band 128 travels from the third anchorage 146 to the fourth anchorage 148 around a second grooved catch 150. Additionally, the third support member 114 includes a double spherical end 152 that seats in a third seat 154 between the first seat 136 and the second seat 138. A third slot 156 is provided, such that when the third support member 114 is moved toward the handle 106, the double spherical end 152 rotates, allowing the third support member 114 to travel along a single plane, through the third slot 156. In the process, the second elastic band 128 comes under tension as the third anchorage 146 and the fourth anchorage 148 to which it is attached travel away from the second grooved catch 150. Thus, when the first support member 110, the second support member 112 and the third support member 114 are adjacent the handle (i.e., the shade 108 is furled preferably around the handle 106) and released, the first elastic band 126 urges the first support member 110 and the second support member 112 to rise, and the second elastic band 128 causes the third support member 114 to rise in tandem with them. In the alternative three-arm embodiment shown, the cap portion 124 includes a cut out designed to allow the third support member 114 to rise higher than the first support member 110 and the second support member 112.

Also included in the body portion 122 of the hub 104 is a portal 158. The portal 158 is provided to allow a cord or cords (not shown) to be connected to the first anchorage 142 of the first support member 110, the second anchorage 144 of the second support member 112, and third anchorage 146 and fourth anchorage 148 of the third support member 114. With the cord 62 or cords travelling through the hub 104, out of the portal 158 and down some distance along the handle 106, the apparatus 100 can be manually operated by pulling on the cord or cords to raise the first support member 110, second support member 112 and third support member 114, and therefore, the shade 108. It is anticipated the body portion 122 of the hub 104 may include a cord anchor adjacent the handle for anchoring the cord or cords when the shade 108 is lifted, thus avoiding a user having to hold the cord or cords under tension to keep the shade 108 up.

Figure 7:
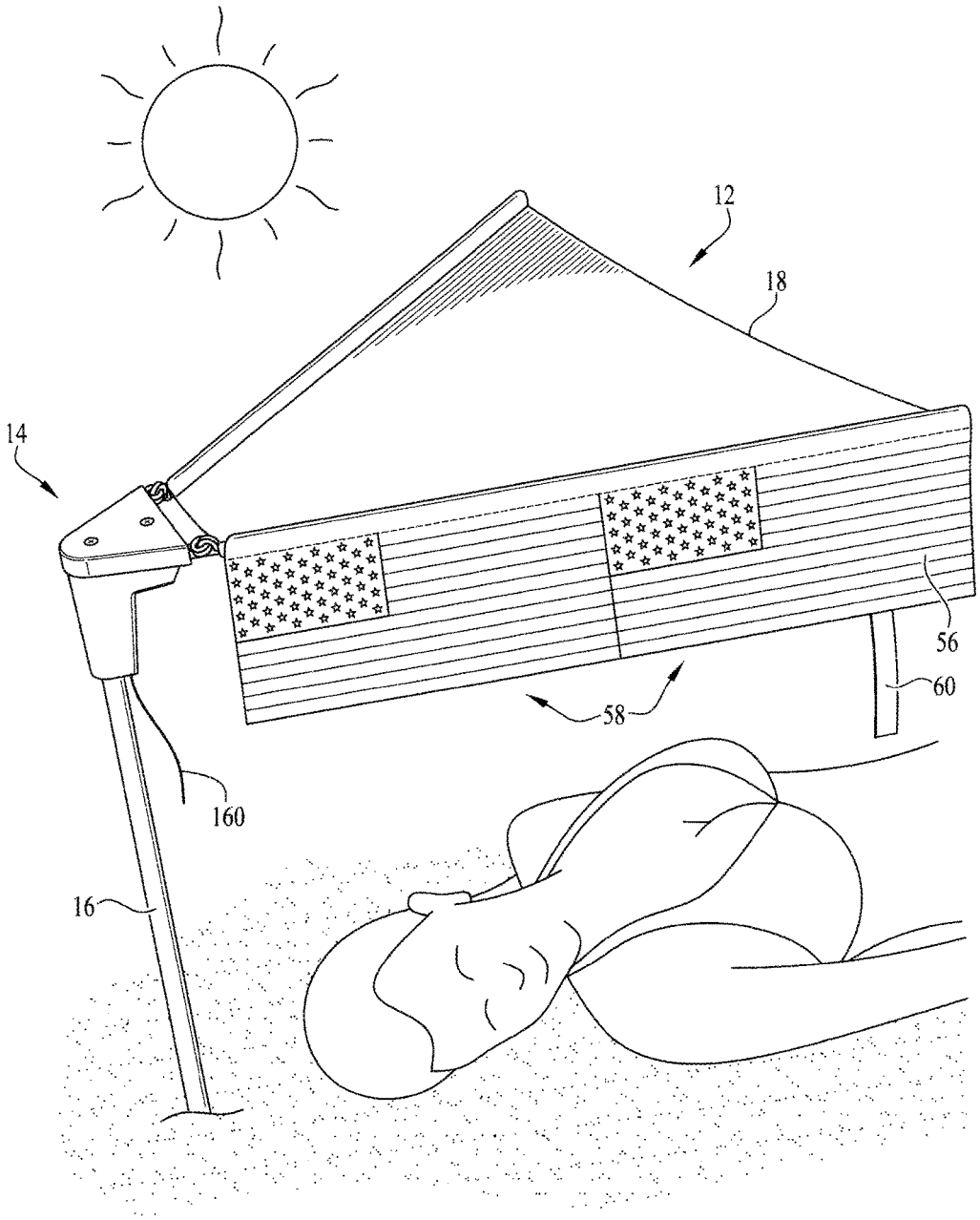
FIG. 7 illustrates the apparatus shielding a user from the sun.

FIG. 7 shows the primary embodiment apparatus 10 in use by a user as a sunshade, including several alternative features that may be present. In the illustrated view, the shade 18 includes a side shade 56 to help provide additional shading to the user. The side shade 56 may also include decorative indicia 58 (a flag pattern in the illustrated embodiment), which is visible when the apparatus 10 is installed and the shade 18 raised to a deployed position. In addition to the side shade 56 and decorative indicia 58, the apparatus 10 may include a securing tab 60. The securing tab 60 functions similar to a conventional umbrella, in that when the first support member 20 and the second support member 22 are urged downward adjacent the handle 16, the securing tab 60 can be used to wrap the shade 18 around the handle 16 and secure it in position until re-deployment.

The apparatus having been shown and described, its method of operation will now be discussed.

It is anticipated, due to the inexpensive nature of the materials and assembly in producing the apparatus 10 that the apparatus 10 may be promotional in nature and thus given away or sold inexpensively. Although any use is contemplated (i.e., to protect from the rain or for shading from sunlight), it is also anticipated one popular use of the apparatus may be to shade the face and head of a sunbather at a beach location. Prior to setting up the apparatus 10, the user will procure the apparatus, either from a business or other agency giving the apparatus 10 to the user, or may have the apparatus 10 already in the user's possession. The apparatus 10 preferably is sold or stored in a secured condition, with the first support member 20 and the second support member 22 folded down under tension against the handle 16, and the shade 18 furled around the handle and secured by the securing tab 60.

When the user desires to deploy the apparatus 10, the user simply releases the securing tab 60. Releasing the securing tab 60 may be done with the user holding the handle 16 of the apparatus, in the manner of a conventional umbrella, or after the handle 16 has been embedded in a surface, such as, using the example discussed above, anchored in the sand at a beach location. Upon releasing the securing tab 60, the first support member 20 and the second support member 22 are free to swing upward through the first slot 52 and the second slot 54, with the first spherical end 40 and the second spherical end 42 acting as hinges, confined between the body portion 34 and the cap portion 36 of the hub 14.

As the first support member 20 and the second support member 22 swing upward, they also move apart by virtue of the angle of the first slot 52 and the second slot, such that the shade 18 is fully unfurled between them when they become substantially perpendicular to the handle. The cap portion 36 of the hub 14 interferes with movement of the first support member 20 and second support member 22 past a substantially perpendicular position relative to the handle 16. Biased movement of the first support member 20 and the second support member 22 is created by the elastic band, which is anchored to the first anchorage 28 and the second anchorage 30 and is stretched around the grooved catch 46.

Once deployed, the apparatus 10 may be used to shade a user from the sun or rain according to preference. After use, to stow the apparatus 10, a user simply folds down the first support member 20 and the second support member 22 until they become adjacent the handle. Thereafter the shade 18 is furled around the handle and secured by the securing tab 60, and the apparatus 10 may be kept until needed once again.

The second embodiment apparatus 100 having an additional third support member 114 is used in virtually the same manner. Due to the second elastic band 128 anchored to the third anchorage 146 and fourth anchorage 148 on the third support member 114, and extending around second grooved catch 150, the third support member 114 will rise in tandem with the first support member 110 and second support member 112. In one preferred embodiment, the cap portion 124 of the hub 104 will include a profile that allows the third support member 114 to rise slightly higher than the first support member 110 and the second support member 112, thus creating a gabled profile in the shade 108 when deployed.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. An automatically deploying delta-shaped aerodynamic shielding apparatus comprising:

a handle portion and a shade portion connected by a hub portion;

the handle portion extending into the hub portion;

the shade portion comprising a flexible shade joined to a first support member and a second support member, wherein the first support member and the second support member extend into the hub portion; and an elastic member extending from the first support member to the second support member, the elastic member further configured to extend through the hub portion;

the first support member and the second support member hingedly coupled to the hub portion; and the elastic member configured to hold the first support member and the second support member under tension at a position substantially perpendicular to the handle portion.

2. The apparatus of claim 1 wherein the handle portion comprises an elongated handle inserted into the hub portion.

3. The apparatus of claim 1 wherein the handle portion comprises a hand grip.

4. The apparatus of claim 1 wherein the shade portion is substantially triangular and delta-shaped.

5. The apparatus of claim 1 wherein the shade further comprises piping, and wherein the first support member and the second support member extend through the piping.

6. The apparatus of claim 1 wherein the first support member comprises a first anchorage and the second support member comprises a second anchorage, with the elastic band coupled between the first anchorage and the second anchorage.

7. The apparatus of claim 1 wherein the first support member comprises a first spherical end and the second support member comprises a second spherical end.

8. The apparatus of claim 1 wherein the hub portion comprises a body portion and a cap portion.

9. The apparatus of claim 8 wherein the body portion comprises a first seat and a second seat.

10. The apparatus of claim 9 wherein the first support member comprises a first spherical end located in the first seat and the second support member comprises a second spherical end located in the second seat.

11. The apparatus of claim 1 wherein the elastic band extends around a grooved catch located in the hub portion.

12. The apparatus of claim 1 wherein the hub portion comprises a first slot and a second slot configured for the first support member and the second support member to move freely through, respectively.

13. An aerodynamic delta-shaped automatically deploying shielding apparatus comprising:

a handle affixed to a hub, the hub comprising a body portion and a cap portion affixed to the body portion;

a flexible shade affixed to a first support member and a second support member, the first support member and the second support member extending into the hub; and a rescue cord extending from the first support member and the second support member, the rescue cord further configured to extend through the hub through a rescue cord portal;

the first support member and the second support member hingedly secured in the hub between the body portion and the cap portion; and the rescue cord configured to anchor in a notch on the hub under tension from the first support member and the second support member, such that the flexible shade is maintained at a position substantially perpendicular to the handle.

14. The apparatus of claim 13 wherein the first support member comprises a first spherical end and the second support member comprises a second spherical end.

15. The apparatus of claim 14 wherein the body portion comprises a first seat and a second seat.

16. The apparatus of claim 15 wherein the first support member comprises a first spherical end disposed in the first seat and the second support member comprises a second spherical end disposed in the second seat.

17. The apparatus of claim 13 wherein the body portion comprises a first slot and a second slot configured for the first support member and the second support member to travel along, respectively.

18. The apparatus of claim 13 further comprising a third support member, the third support member extending into the hub, with the rescue cord anchored to the third support member.

19. The apparatus of claim 18 further comprising a plurality of rescue cords.

20. An aerodynamic delta-shaped automatically deploying shielding apparatus comprising:

a hub having a handle affixed thereto in a static relationship, the handle extending distally from the hub;

a shade affixed to a first support member, a second support member, and a third support member, the shade hingedly coupled to the hub by the first support member, the second support member, and the third support member;

the hub further comprising a first slot, a second slot, and a third slot, the first slot, the second slot, and the third slot configured for the first support member, the second support member, and the third support member to travel therethrough, respectively; and an elastic member extending between the first support member and the second support member, the first elastic member configured to hold the first support member and the second support member under tension at a position substantially perpendicular to the handle.

* * * * *